US010981388B2

(12) United States Patent
Nishimura

(10) Patent No.: US 10,981,388 B2
(45) Date of Patent: Apr. 20, 2021

(54) INPUT/OUTPUT (I/O) DESIGN OF A PRINTHEAD ALLOWING FOR DAISY-CHAINING

(71) Applicant: Hiroshi Nishimura, West Hills, CA (US)

(72) Inventor: Hiroshi Nishimura, West Hills, CA (US)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/351,147

(22) Filed: Mar. 12, 2019

(65) Prior Publication Data

US 2020/0290341 A1 Sep. 17, 2020

(51) Int. Cl.

| | |
|---|---|
| ***B41J 2/175*** | (2006.01) |
| ***B41J 2/18*** | (2006.01) |
| ***B41J 2/155*** | (2006.01) |
| ***B41J 29/02*** | (2006.01) |

(52) U.S. Cl.

CPC ..... *B41J 2/175* (2013.01); *B41J 2/155* (2013.01); *B41J 2/18* (2013.01); *B41J 29/02* (2013.01); *B41J 2202/20* (2013.01)

(58) Field of Classification Search

CPC ..... B41J 2/175

See application file for complete search history.

(56) References Cited

U.S. PATENT DOCUMENTS

| | | | | |
|---|---|---|---|---|
| 7,661,798 | B2 * | 2/2010 | Mukai | B41J 2/175 347/56 |
| 8,851,643 | B2 * | 10/2014 | Tsubaki | B41J 2/175 347/84 |
| 9,669,633 | B1 * | 6/2017 | Nishimura | B41J 2/17523 |
| 2005/0243146 | A1 * | 11/2005 | Essen | B41J 2/145 347/84 |
| 2009/0141084 | A1 * | 6/2009 | Kim | B41J 2/155 347/50 |
| 2009/0295882 | A1 * | 12/2009 | Hagiwara | B41J 2/155 347/85 |
| 2013/0235131 | A1 * | 9/2013 | Watanabe | B41J 2/17509 347/86 |
| 2014/0292933 | A1 * | 10/2014 | Hagiwara | B41J 2/17563 347/47 |
| 2015/0077473 | A1 * | 3/2015 | Wanibe | B41J 29/377 347/50 |
| 2015/0251454 | A1 * | 9/2015 | Ochi | B41J 2/175 347/102 |
| 2017/0253048 | A1 * | 9/2017 | Nishimura | B41J 2/17523 |

FOREIGN PATENT DOCUMENTS

| | | | | |
|---|---|---|---|---|
| DE | 19743804 | A1 * | 4/1999 | B41J 2/16552 |
| EP | 2065198 | A1 * | 6/2009 | B41J 2/175 |
| JP | 2003080711 | A * | 3/2003 | |
| JP | 2009285900 | A * | 12/2009 | |
| WO | WO-2019078868 | A1 * | 4/2019 | B41J 2/175 |

* cited by examiner

*Primary Examiner* — Julian D Huffman
(74) *Attorney, Agent, or Firm* — Duft & Bornsen, PC

(57) ABSTRACT

Printheads for a jetting apparatus. In one embodiment, a printhead comprises a plurality of jetting channels having nozzles on a bottom surface configured to jet a print fluid, and longitudinal sides disposed between the bottom surface and a top surface. The printhead also comprises Input/Output (I/O) ports disposed on one or more of the longitudinal sides, and configured to convey the print fluid into or out of the printhead. The printhead further includes one or more chain manifolds disposed between the I/O ports.

18 Claims, 7 Drawing Sheets

INPUT/OUTPUT (I/O) DESIGN OF A PRINTHEAD ALLOWING FOR DAISY-CHAINING

TECHNICAL FIELD

The following disclosure relates to the field of image formation, and in particular, to printheads and the use of printheads.

BACKGROUND

Image formation is a procedure whereby a digital image is recreated on a medium by propelling droplets of ink or another type of print fluid onto a medium, such as paper, plastic, a substrate for 3D printing, etc. Image formation is commonly employed in apparatuses, such as printers (e.g., inkjet printer), facsimile machines, copying machines, plotting machines, multifunction peripherals, etc. The core of a typical jetting apparatus or image forming apparatus is one or more liquid-droplet ejection heads (referred to generally herein as "printheads") having nozzles that discharge liquid droplets, a mechanism for moving the printhead and/or the medium in relation to one another, and a controller that controls how liquid is discharged from the individual nozzles of the printhead onto the medium in the form of pixels.

A typical printhead includes a plurality of nozzles aligned in one or more rows along a discharge surface of the printhead. Each nozzle is part of a "jetting channel", which includes the nozzle, a pressure chamber, and a diaphragm that is driven by an actuator, such as a piezoelectric actuator. A printhead also includes a drive circuit that controls when each individual jetting channel fires based on image data. To jet from a jetting channel, the drive circuit provides a jetting pulse to the actuator, which causes the actuator to deform a wall of the pressure chamber via the diaphragm. The deformation of the pressure chamber creates pressure waves within the pressure chamber that eject a droplet of print fluid (e.g., ink) out of the nozzle.

Opposite the discharge surface of the printhead is the Input/Output (I/O) surface, where a print fluid is supplied to the printhead, or conveyed out of the printhead (such as with a flow-through head). The I/O surface includes I/O ports that typically connected to a reservoir or the like via a hose. Unfortunately, it may be cumbersome to connect the printheads to the reservoirs with the present I/O design.

SUMMARY

Embodiments described herein comprise a printhead having one or more I/O ports situated on one side or both sides. The printhead also has one or more manifolds that fluidly couple the I/O ports on one side of the printhead, or fluidly couple the I/O ports on opposing sides of the printhead. Based on the configuration of the I/O ports and manifolds, printheads may be daisy-chained together so that a print fluid flows from one printhead to another in a supply chain. Thus, it is not necessary to run a hose to each individual printhead, making set up and operation more efficient.

One embodiment comprises a printhead that includes a plurality of jetting channels having nozzles on a bottom surface configured to jet a print fluid, and longitudinal sides disposed between the bottom surface and a top surface. The printhead further includes I/O ports disposed on one or more of the longitudinal sides, and configured to convey the print fluid into or out of the printhead. The printhead further includes one or more chain manifolds disposed between the I/O ports.

In another embodiment, the I/O ports comprise a first I/O port and a second I/O port disposed on a first one of the longitudinal sides.

In another embodiment, the printhead further includes one or more supply manifolds disposed longitudinally, and configured to fluidly couple the first I/O port and the second I/O port to the jetting channels.

In another embodiment, a first one of the supply manifolds and the chain manifold(s) are defined by a common duct within the printhead.

In another embodiment, the I/O ports further comprise a third I/O port and a fourth I/O port disposed on a second one of the longitudinal sides opposite the first one of the longitudinal sides. A first chain manifold of the chain manifold(s) fluidly couples the first I/O port on the first one of the longitudinal sides to the third I/O port on the second one of the longitudinal sides. A second chain manifold of the chain manifold(s) fluidly couples the second I/O port on the first one of the longitudinal sides to the fourth I/O port on the second one of the longitudinal sides.

In another embodiment, the first I/O port is staggered in relation to the third I/O port, and the first chain manifold is disposed at an angle across a width of the printhead between the first I/O port and the third I/O port. The second I/O port is staggered in relation to the fourth I/O port, and the second chain manifold is disposed at an angle across the width of the printhead between the second I/O port and the fourth I/O port.

In another embodiment, one or more of the I/O ports includes an O-ring.

In another embodiment, one or more of the I/O ports includes a hose coupling.

Another embodiment comprises a jetting apparatus that includes a mounting bracket configured to mount multiple ones of the printhead in a daisy chain.

Another embodiment comprises a jetting apparatus that includes a plurality of printheads installed perpendicular to a direction of relative movement between the printheads and a medium. Each printhead of the plurality comprises a plurality of jetting channels having nozzles configured to jet a print fluid, I/O ports disposed on a longitudinal side of the printhead, and a chain manifold disposed between the I/O ports. The printheads are installed as a daisy-chain via the I/O ports and the chain manifold so that the print fluid flows from one of the printheads to another of the printheads.

In another embodiment, the printheads are installed with an outlet I/O port of one of the printheads aligned with an inlet I/O port of another of the printheads.

In another embodiment, the jetting apparatus further comprises an O-ring configured to seal a connection between the outlet I/O port and the inlet I/O port.

In another embodiment, the printheads at ends of the daisy-chain are connected to a reservoir via a hose.

In another embodiment, the printhead further comprises one or more supply manifolds disposed longitudinally, and configured to fluidly couple the I/O ports to the jetting channels. A first one of the supply manifolds and the chain manifold are defined by a common duct.

Another embodiment comprises a jetting apparatus that includes a plurality of printheads. Each printhead of the plurality comprises a plurality of jetting channels having nozzles configured to jet a print fluid, I/O ports that comprise a first I/O port and a second I/O port disposed on a first longitudinal side of the printhead, and a third I/O port and a fourth I/O port disposed on a second longitudinal side of the printhead opposite the first longitudinal side, a first chain manifold disposed between the first I/O port on the first longitudinal side and the third I/O port on the second longitudinal side, and a second chain manifold disposed between the second I/O port on the first longitudinal side and the fourth I/O port on the second longitudinal side. The printheads are installed as a daisy-chain via the I/O ports, the first chain manifold, and the second chain manifold so that the print fluid flows from one of the printheads to another of the printheads In another embodiment, the printheads are installed with an outlet I/O port of one of the printheads aligned with an inlet I/O port of another of the printheads.

In another embodiment, the jetting apparatus further comprises an O-ring configured to seal a connection between the outlet I/O port and the inlet I/O port.

In another embodiment, the printheads at ends of the daisy-chain are connected to a reservoir via a hose.

In another embodiment, the printheads are installed at an angle to a direction of relative movement between the printheads and a medium.

In another embodiment, the first I/O port is staggered in relation to the third I/O port, and the first chain manifold is disposed at an angle across a width of the printhead between the first I/O port and the third I/O port. The second I/O port is staggered in relation to the fourth I/O port, and the second chain manifold is disposed at an angle across the width of the printhead between the second I/O port and the fourth I/O port.

In another embodiment, the printheads are installed parallel to a direction of relative movement between the printheads and a medium.

In another embodiment, the first I/O port is transversely aligned with the third I/O port, and the first chain manifold is disposed transversely across a width of the printhead between the first I/O port and the third I/O port. The second I/O port is transversely aligned with the fourth I/O port, and the second chain manifold is disposed transversely across the width of the printhead between the second I/O port and the fourth I/O port.

In another embodiment, the printhead further comprises one or more supply manifolds disposed longitudinally, and configured to fluidly couple the I/O ports to the jetting channels. The supply manifolds are fluidly coupled at one end to the first chain manifold, and fluidly coupled at the other end to the second chain manifold.

The above summary provides a basic understanding of some aspects of the specification. This summary is not an extensive overview of the specification. It is intended to neither identify key or critical elements of the specification nor delineate any scope particular embodiments of the specification, or any scope of the claims. Its sole purpose is to present some concepts of the specification in a simplified form as a prelude to the more detailed description that is presented later.

DESCRIPTION OF THE DRAWINGS

Some embodiments of the present disclosure are now described, by way of example only, and with reference to the accompanying drawings. The same reference number represents the same element or the same type of element on all drawings.

DETAILED DESCRIPTION

The figures and the following description illustrate specific exemplary embodiments. It will thus be appreciated that those skilled in the art will be able to devise various arrangements that, although not explicitly described or shown herein, embody the principles of the embodiments and are included within the scope of the embodiments. Furthermore, any examples described herein are intended to aid in understanding the principles of the embodiments, and are to be construed as being without limitation to such specifically recited examples and conditions. As a result, the inventive concept(s) is not limited to the specific embodiments or examples described below, but by the claims and their equivalents.

Figure 1:
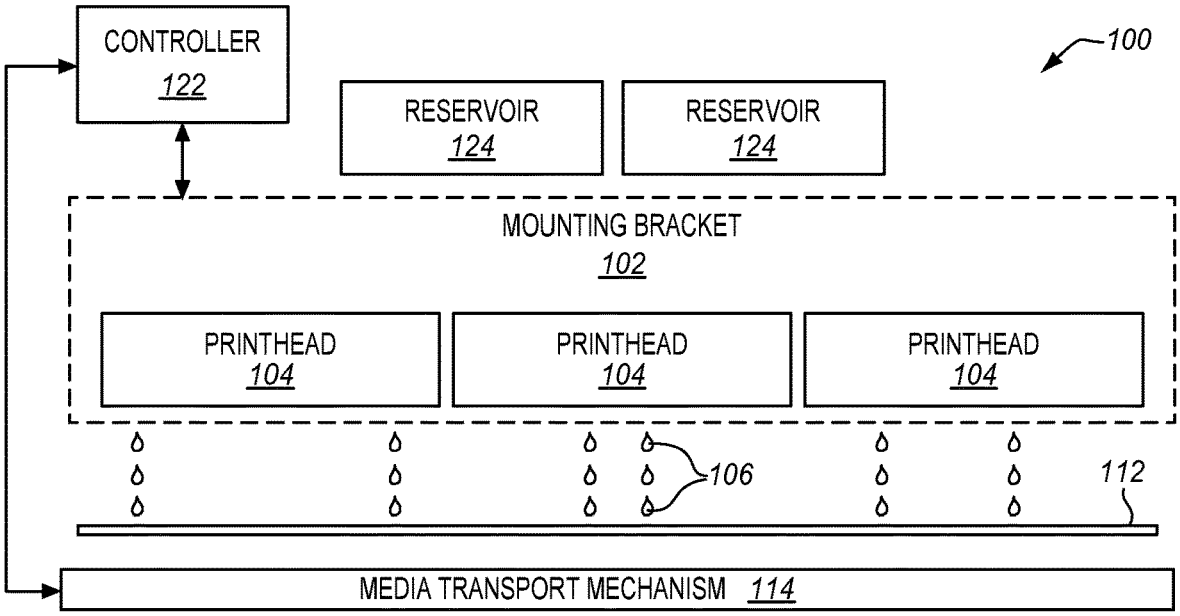
FIG. 1 is a schematic diagram of a jetting apparatus in an illustrative embodiment.

FIG. 1 is a schematic diagram of a jetting apparatus 100 in an illustrative embodiment. One example of jetting apparatus 100 is an inkjet printer that performs single-pass or multi-pass printing. Jetting apparatus 100 includes a mounting bracket 102 that supports one or more printheads 104 above a medium 112. Mounting bracket 102 may be disposed on a carriage assembly that reciprocates back and forth along a scan line or scan directions for multi-pass printing. Alternatively, mounting bracket 102 may be fixed within jetting apparatus 100 for single-pass printing. Printheads 104 are a device, apparatus, or component configured to eject droplets 106 of a print fluid, such as ink (e.g., water, solvent, oil, or UV-curable), through a plurality of orifices or nozzles (not visible in FIG. 1). The droplets 106 ejected from the nozzles of printheads 104 are directed toward medium 112. Medium 112 comprises any type of material upon which ink or another print fluid is applied by a printhead, such as paper, plastic, card stock, transparent sheets, a substrate for 3D printing, cloth, etc. Typically, nozzles of printheads 104 are arranged in one or more rows so that ejection of print fluid from the nozzles causes formation of characters, symbols, images, layers of an object, etc., on medium 112 as printhead 104 and/or medium 112 are moved relative to one another. Media transport mechanism 114 is configured to move medium 112 relative to printheads 104. Jetting apparatus 100 also includes a jetting apparatus controller 122 that controls the overall operation of jetting apparatus 100. Jetting apparatus controller 122 may connect to a data source to receive image data, and control each printhead 104 to discharge the print fluid on a desired pixel grid on medium 112. Jetting apparatus 100 also includes one or more reservoirs 124 for a print fluid. Although not shown in FIG. 1, reservoirs 124 may be connected to one or more of printheads 104 via hoses or the like.

Figure 2:
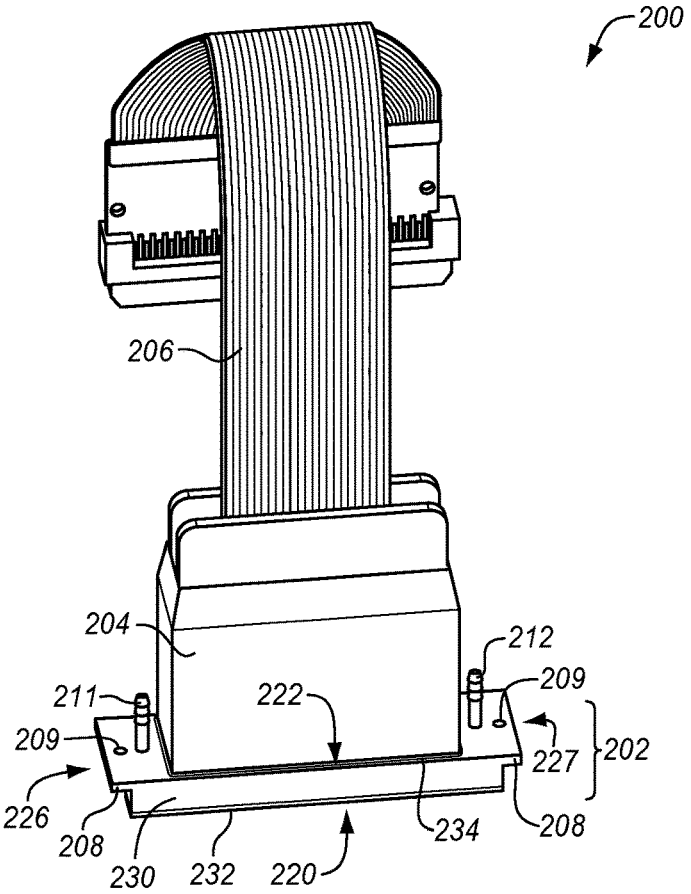
FIG. 2 is a perspective view of a conventional printhead.

FIG. 2 is a perspective view of a conventional printhead 200 for a jetting apparatus. Printhead 200 includes a head member 202 and electronics 204. Head member 202 is an elongated component that forms the jetting channels of printhead 200. A typical jetting channel includes a nozzle, a pressure chamber, and a diaphragm that is driven by an actuator, such as a piezoelectric actuator. Electronics 204 control how the nozzles of printhead 200 jet droplets in response to control signals. Although not visible in FIG. 2, electronics 204 may include a plurality of actuators (e.g., piezoelectric actuators) that contact the diaphragms of the jetting channels. Electronics 204 also include cabling 206, such as a ribbon cable, that connects to a controller (e.g., jetting apparatus controller 122) to receive the control signals. Printhead 200 also includes attachment members 208, which are configured to secure printhead 200 to a jetting apparatus, such as to mounting bracket 102 as illustrated in FIG. 1. Attachment members 208 may include one or more holes 209 so that printhead 200 may be mounted within a jetting apparatus by screws, bolts, pins, etc.

The bottom surface 220 of head member 202 includes the nozzles of the jetting channels, and represents the discharge surface of printhead 200. The top surface 222 of head member 202 represents the I/O portion for receiving print fluids into printhead 200 and/or conveying print fluids (e.g., fluids that are not jetted) out of printhead 200. Top surface 222, which is also referred to as the I/O surface, includes a plurality of I/O ports 211-212. Top surface 222 has two ends 226-227 that are separated by electronics 204. I/O port 211 is disposed toward end 226, and I/O port 212 is disposed toward end 227.

Head member 202 includes a housing 230 and a plate stack 232. Housing 230 is a rigid member made from stainless steel or another type of material. Housing 230 includes an access hole 234 that provides a passageway for electronics 204 to pass through housing 230 so that actuators may interface with diaphragms of the jetting channels. Plate stack 232 attaches to an interface surface (not visible) of housing 230. Plate stack 232 (also referred to as a laminate plate stack) is a series of plates that are fixed or bonded to one another to form a laminated stack. Plate stack 232 may include the following plates: one or more nozzle plates, one or more chamber plates, one or more restrictor plates, and a diaphragm plate. A nozzle plate includes a plurality of nozzles that are arranged in one or more rows (e.g., two rows, four rows, etc.). A chamber plate includes a plurality of openings that form the pressure chambers of the jetting channels. A restrictor plate includes a plurality of restrictors that fluidly connect the pressure chambers of the jetting channels with a supply manifold. A diaphragm plate is a sheet of a semi-flexible material that vibrates in response to actuation by an actuator (e.g., piezoelectric actuator).

Figure 3:
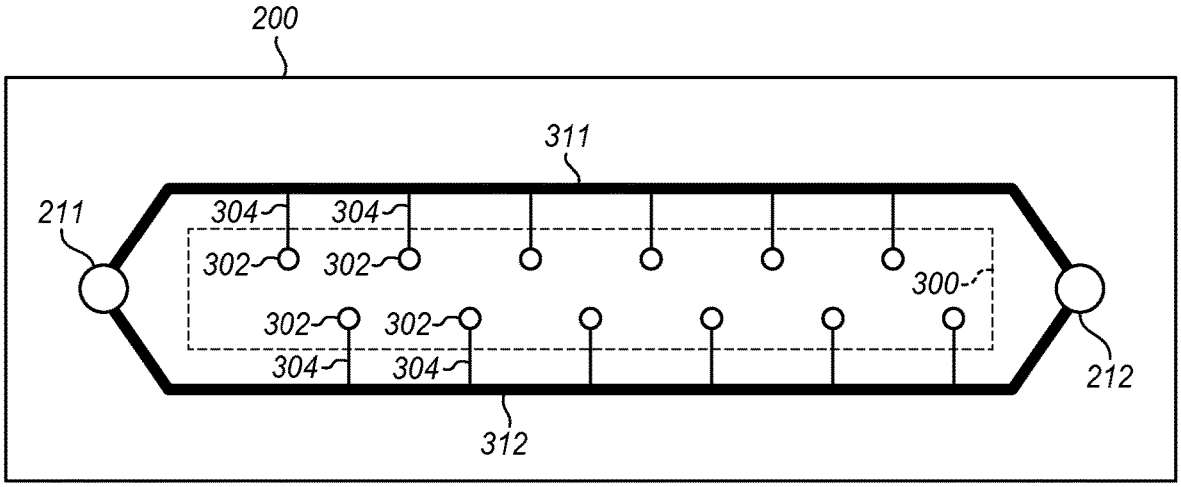
FIG. 3 is a schematic diagram of a conventional printhead.

FIG. 3 is a schematic diagram of printhead 200. The jetting channels 300 of printhead 200 are schematically illustrated in FIG. 3 as nozzles in two nozzle rows. Printhead 200 includes supply manifolds 311-312 that are disposed longitudinally. A supply manifold is a groove, duct, conduit, etc., within head member 202 that is configured to convey or supply a print fluid to jetting channels. Supply manifold 311 is fluidly coupled between I/O ports 211-212, and is also fluidly coupled to a subset of the jetting channels 300 indicated by nozzles 302 via fluid path 304. Supply manifold 312 is fluidly coupled between I/O ports 211-212, and is also fluidly coupled to a subset of the jetting channels 300 indicated by nozzles 302 via fluid path 304. Fluid paths 304 are provided in the form of a restrictor, which is a passageway that fluidly couples a supply manifold to a pressure chamber and prevents a backflow of print fluid.

Although this design of printhead 200 is effective for its intended purpose, operators may want flexibility in how multiple printheads are connected within a jetting apparatus. In the embodiments described below, the I/O portion is disposed on the side(s) of the printhead, and a manifold(s) (referred to herein as a chain manifold) is disposed through the printhead so that a print fluid may flow through the printhead between I/O ports to act as a supply for another printhead. With this design, multiple printheads may be daisy-chained together within a jetting apparatus.

Figure 4:
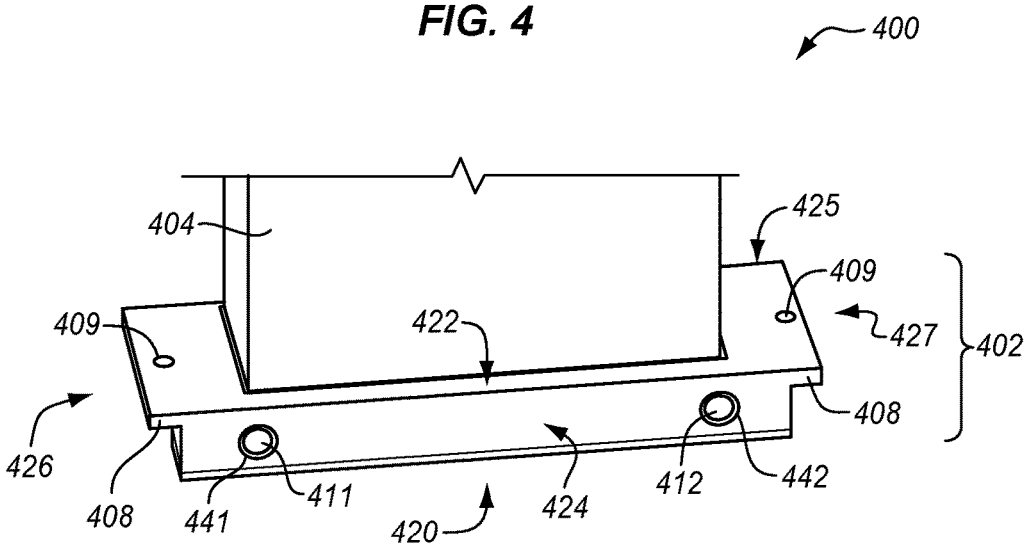
FIG. 4 is a perspective view of a printhead in an illustrative embodiment.

FIG. 4 is a perspective view of a printhead 400 in an illustrative embodiment. Printhead 400 may be an example of a printhead 104 as installed in jetting apparatus 100. As above for printhead 200, printhead 400 includes a head member 402 and electronics 404. Head member 402 is an elongated component that forms the jetting channels of printhead 400. Printhead 400 includes attachment members 408 that are configured to secure printhead 400 to a jetting apparatus, such as to mounting bracket 102 as illustrated in FIG. 1. Attachment members 408 may include one or more holes 409 so that printhead 400 may be mounted within a jetting apparatus by screws, bolts, pins, etc. The bottom surface 420 of head member 402 includes the nozzles of the jetting channels, and represents the discharge surface of printhead 400. The top surface 422 of head member 402 is opposite the discharge surface.

Printhead 400 has longitudinal sides 424-425 disposed between bottom surface 420 and top surface 422. One or both of longitudinal sides 424-425 represents the I/O portion for receiving print fluids into printhead 400 and/or conveying print fluids (e.g., fluids that are not jetted) out of printhead 400. Longitudinal side 424 includes one or more I/O ports 411-412. I/O ports 411-412 are spaced by a distance (e.g., a distance more than the length of the jetting channels) so that I/O port 411 is disposed on longitudinal side 424 toward end 426, while I/O port 412 is disposed on longitudinal side 424 toward end 427. An I/O port 411-412 comprises an opening in head member 402 that acts as an entry point for a print fluid, and/or an exit point for a print fluid. I/O ports 411-412 may include a hose coupling, hose barb, etc., for coupling with a supply hose of a reservoir, a cartridge, or the like. I/O ports 411-412 may include an O-ring 441-442, a gasket, a seal, or the like, for coupling with another I/O port of another printhead.

Figure 5:
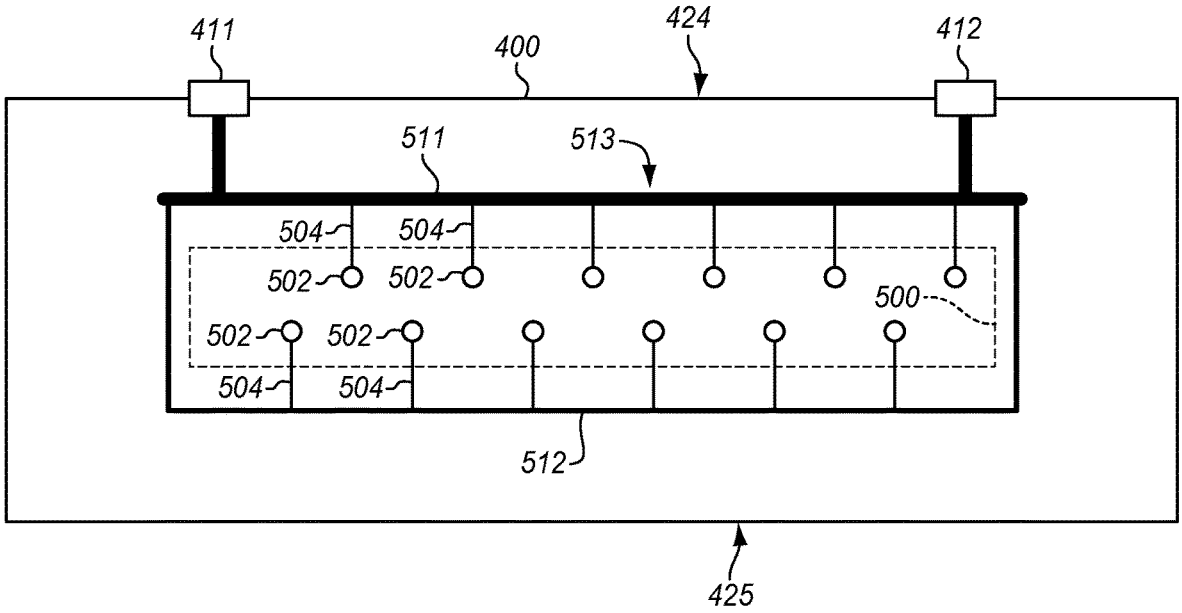
FIG. 5 is a schematic diagram of a printhead in an illustrative embodiment.

FIG. 5 is a schematic diagram of printhead 400 in an illustrative embodiment. The jetting channels 500 of printhead 400 are schematically illustrated in FIG. 5 as nozzles in two nozzle rows, although the nozzles may be arranged in more or less nozzle rows in other embodiments. Printhead 400 includes one or more supply manifolds 511-512 that are disposed longitudinally within printhead 400. As stated above, a supply manifold is a groove, duct, conduit, etc., configured to convey or supply a print fluid to jetting channels. In this embodiment, supply manifold 511 is fluidly coupled to a subset of the jetting channels 500 (or each of the jetting channels 500 in the case of a flow-through printhead) indicated by nozzles 502 via fluid path 504. Supply manifold 512 is fluidly coupled to a subset of the jetting channels 500 (or each of the jetting channels 500 in the case of a flow-through printhead) indicated by nozzles 502 via fluid path 504. Fluid paths 504 are provided in the form of restrictors, which are passageways that fluidly couple a supply manifold to a pressure chamber and prevents a backflow of print fluid. Although two supply manifolds are illustrated, there may be a single supply manifold (e.g., such as in the case of a single row of jetting channels), or more than two supply manifolds.

In this embodiment, printhead 400 includes a pair of I/O ports 411-412 on longitudinal side 424. Supply manifold 511 fluidly couples I/O ports 411-412, and may further define a chain manifold 513 within printhead 400. A chain manifold 513 comprises a groove, duct, conduit, etc., configured to convey a print fluid through a printhead for transfer to another printhead. A purpose of a chain manifold is to provide a passageway for a print fluid through a printhead so that multiple printheads may be daisy-chained together. Thus, the size, design, etc., of a chain manifold may be different than a supply manifold, which is used to supply a print fluid to jetting channels. For example, a chain manifold 513 may be larger in size or have a lower flow resistance than a regular supply manifold 512. Supply manifold 511/chain manifold 513 may comprise a duct formed within head member 402, and supply manifold 512 may also comprise a duct formed within head member 402. In this embodiment, the duct common for supply manifold 511/chain manifold 513 may be larger than the duct for supply manifold 512 so that the common duct acts as both a supply manifold and a chain manifold. Supply manifold 511/chain manifold 513 fluidly couples I/O port 411 on longitudinal side 424 with I/O port 412 on the same side. With this configuration, printhead 400 may be installed in a jetting apparatus perpendicular to the direction of relative movement between printhead 400 and the medium.

Figure 6:
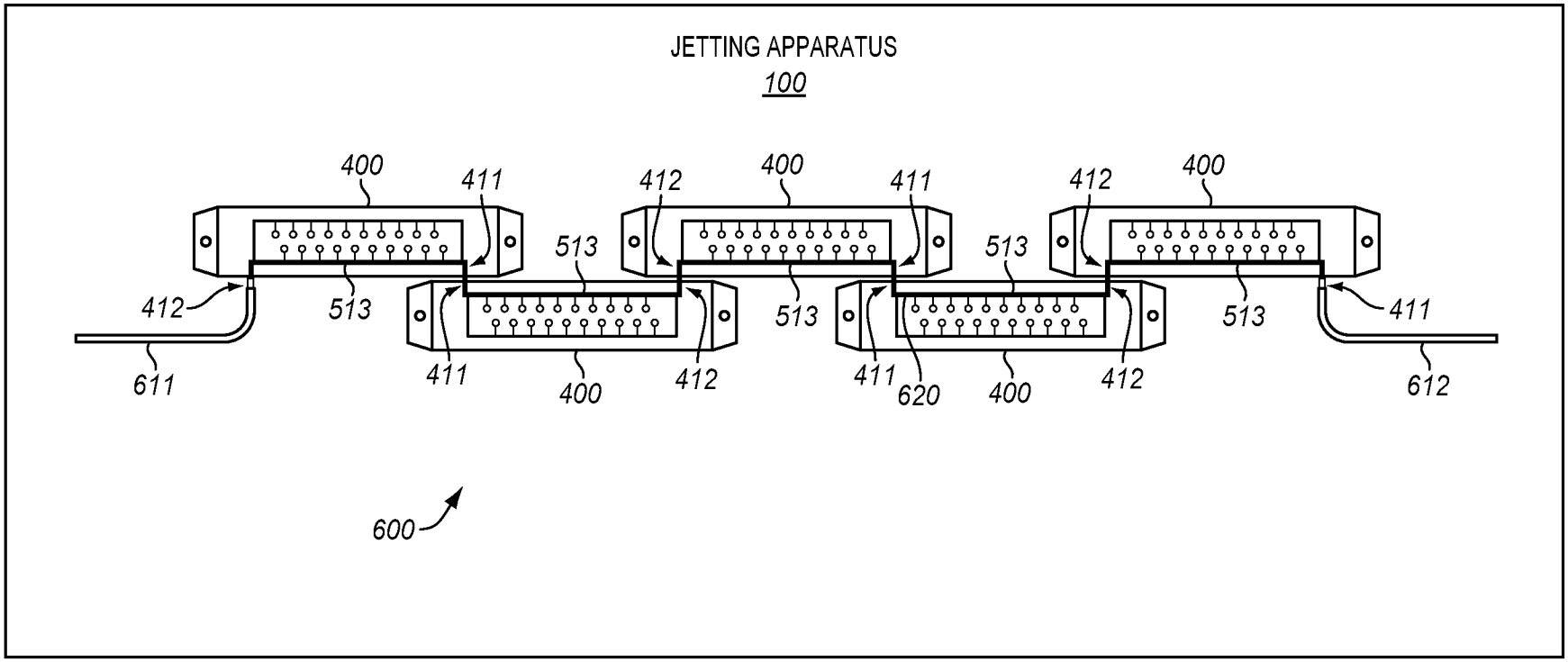
FIG. 6 illustrates multiple printheads mounted in a jetting apparatus in an illustrative embodiment.

FIG. 6 illustrates multiple printheads 400 mounted in a jetting apparatus 100 in an illustrative embodiment. Printheads 400 are installed perpendicular to the direction of relative movement between printheads 400 and the medium. Printheads 400 are installed as a daisy-chain 600 so that a print fluid flows from one printhead to another. I/O ports 411-412 may act as an "inlet" I/O port that receives a flow of print fluid, or an "outlet" I/O port that conveys a flow of print fluid out of a printhead depending on where a printhead 400 is installed in the chain. For example, the "inlet" I/O port 412 on the left-most printhead 400 (i.e., the first printhead) is connected to a supply hose 611, which is in turn connected to a reservoir or the like. The "outlet" I/O port 411 on the left-most printhead 400 is fluidly coupled to the "inlet" I/O port 411 on the next printhead 400 (i.e., the second printhead) in the chain. I/O port 412 on the second printhead 400 is fluidly coupled to I/O port 412 on the next printhead 400 (i.e., third printhead) in the chain. On the last printhead 400 (i.e., the fifth printhead) in the chain, I/O port 411 is fluidly coupled to a return hose 612 (or another supply hose), which is in turn connected to a reservoir or the like. Printheads 400 may be mounted in jetting apparatus 100 so that the "inlet" I/O port on one printhead 400 is aligned with the "outlet" I/O port on another printhead 400. An O-ring, gasket, seal, or the like may be used to seal the connection between an "inlet" I/O port and an "outlet" I/O port.

As is evident in FIG. 6, the ends of daisy-chain 600 (e.g., the leftmost and rightmost printheads 400) are connected to one or more reservoirs via hoses 611-612. The printheads 400 are linked together via I/O ports and chain manifold 513 to form an integrated chain manifold 620. For example, a print fluid may flow from supply hose 611, into the leftmost printhead 400, and along integrated chain manifold 620 until exiting the chain at the rightmost printhead 400 through hose 612. Thus, the interior printheads 400 do not need to be directly connected to a reservoir via a hose, and print fluid may be supplied to these printheads 400 through integrated chain manifold 620. This makes the printheads 400 easier to install in jetting apparatus 100, and easier to maintain.

Figure 7:
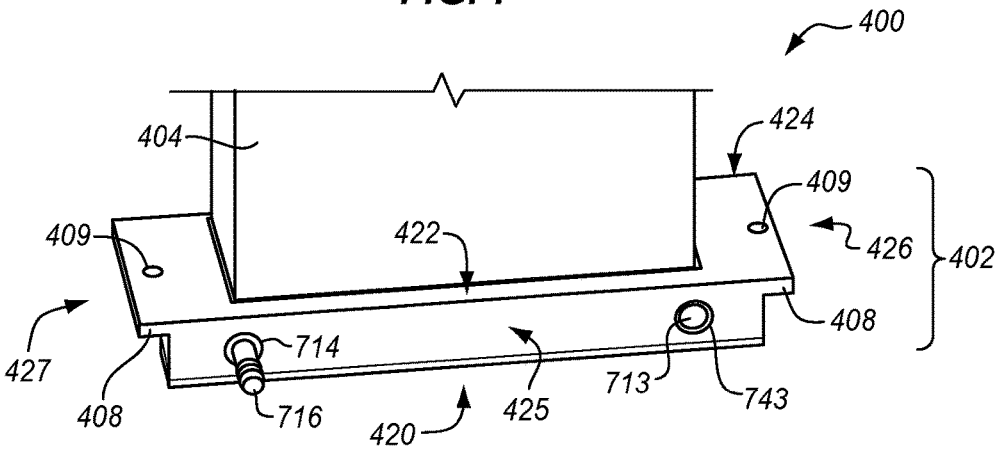
FIG. 7 is another perspective view of a printhead in an illustrative embodiment.

FIG. 7 is another perspective view of a printhead 400 in an illustrative embodiment. In this embodiment, longitudinal side 425 of printhead 400 includes one or more I/O ports 713-714. I/O ports 713-714 are spaced by a distance (e.g., a distance more than the length of the jetting channels) so that I/O port 713 is disposed on longitudinal side 425 toward end 426, while I/O port 714 is disposed on longitudinal side 425 toward end 427. As above, I/O ports 713-714 may include a hose coupling 716, hose barb, etc., for coupling with a supply hose of a reservoir, a cartridge, or the like. I/O ports 713-714 may include an O-ring 743, a gasket, a seal, or the like, for coupling with another I/O port of another printhead.

Figure 8:
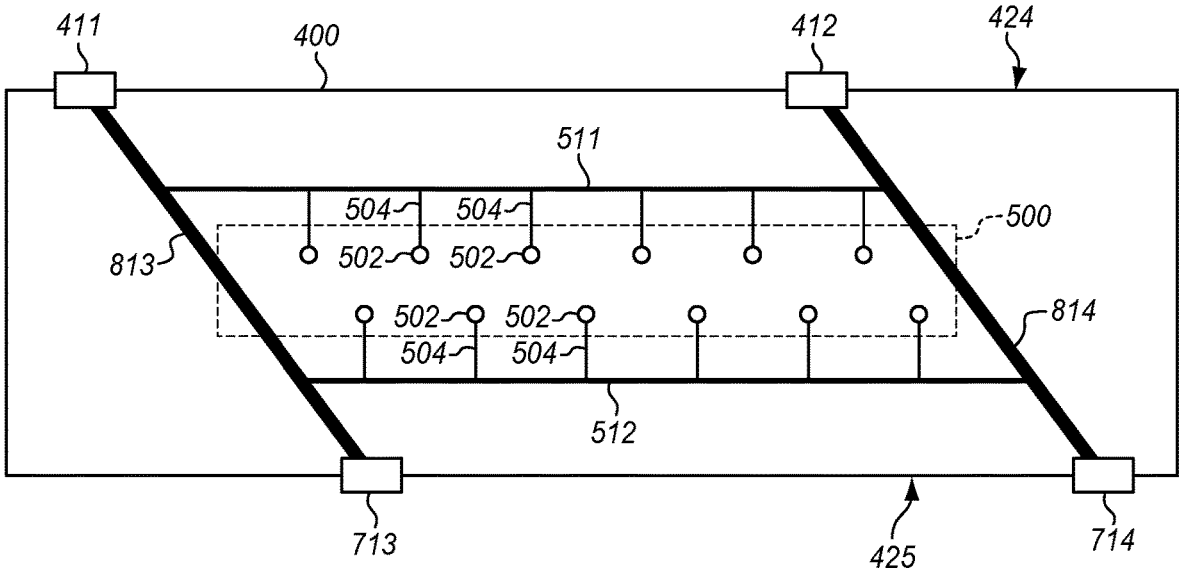
FIG. 8 is a schematic diagram of a printhead in another illustrative embodiment.

FIG. 8 is a schematic diagram of a printhead 400 in another illustrative embodiment. The jetting channels 500 of printhead 400 are schematically illustrated in FIG. 8 as nozzles in two nozzle rows, although the nozzles may be arranged in more or less nozzle rows in other embodiments. Printhead 400 includes one or more supply manifolds 511-512 that are disposed longitudinally within printhead 400. As stated above, a supply manifold is a groove, duct, conduit, etc., configured to convey or supply a print fluid to jetting channels. In this embodiment, supply manifold 511 is fluidly coupled to a subset of the jetting channels 500 (or each of the jetting channels 500 in the case of a flow-through printhead) indicated by nozzles 502 via fluid path 504. Supply manifold 512 is fluidly coupled to a subset of the jetting channels 500 (or each of the jetting channels 500 in the case of a flow-through printhead) indicated by nozzles 502 via fluid path 504. Fluid paths 504 are provided in the form of restrictors. Although two supply manifolds are illustrated, there may be a single supply manifold (e.g., such as in the case of a single row of jetting channels), or more than two supply manifolds.

In this embodiment, printhead 400 includes a pair of I/O ports 411-412 on longitudinal side 424, and a pair of I/O ports 713-714 on longitudinal side 425. Printhead 400 also includes chain manifolds 813-814. Chain manifold 813 fluidly couples I/O port 713 on longitudinal side 425 with I/O port 411 on longitudinal side 424. I/O port 713 is staggered in relation to I/O port 411, meaning that they are not transversely aligned across the width of printhead 400. Thus, chain manifold 813 is disposed at an angle across the width of printhead 400 between I/O port 713 and I/O port 411. Chain manifold 814 fluidly couples I/O port 714 on longitudinal side 425 with I/O port 412 on longitudinal side 424. I/O port 714 is staggered in relation to I/O port 412, meaning that they are not transversely aligned across the width of printhead 400. Thus, chain manifold 814 is disposed at an angle across the width of printhead 400 between I/O port 714 and I/O port 412. With this configuration, printhead 400 may be installed in a jetting apparatus at an angle in relation to the direction of relative movement between printhead 400 and the medium. Supply manifolds 511-512 are fluidly coupled at one end to chain manifold 813, and fluidly coupled at the other end to chain manifold 814.

Figure 9:
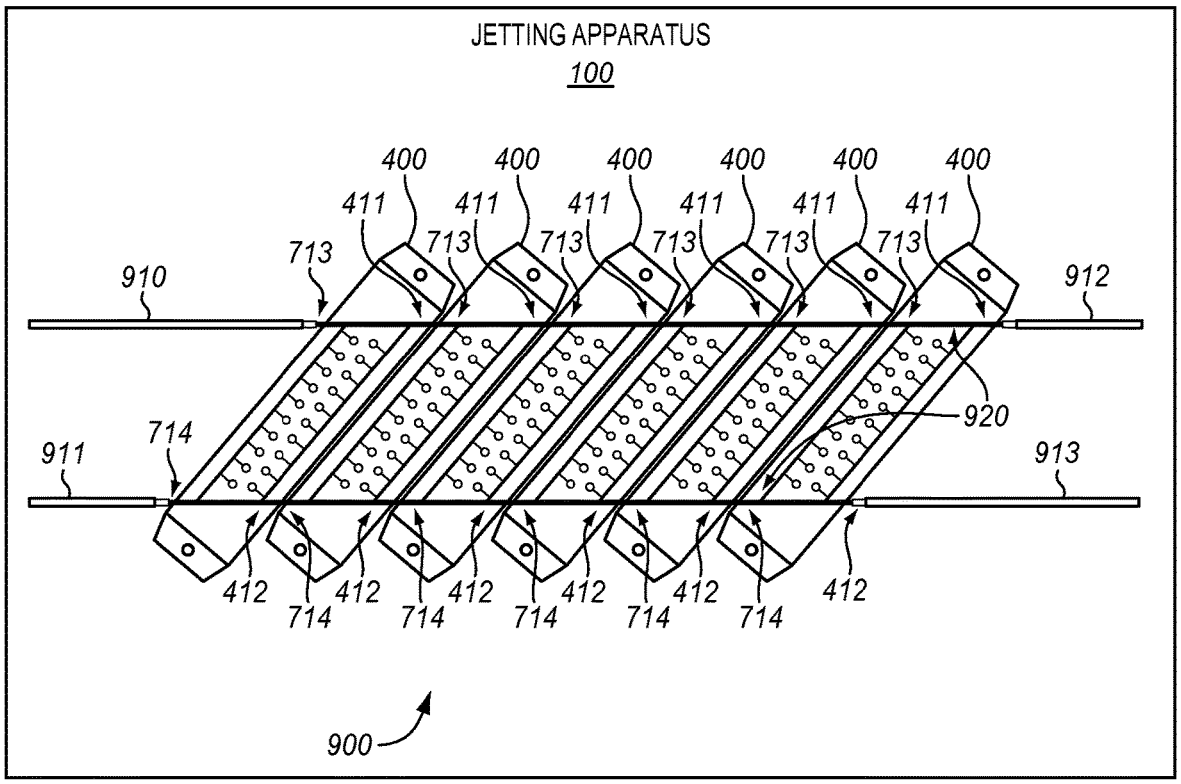
FIG. 9 illustrates multiple printheads mounted in a jetting apparatus in an illustrative embodiment.

FIG. 9 illustrates multiple printheads 400 mounted in a jetting apparatus 100 in an illustrative embodiment. In this embodiment, printheads 400 are installed at an angle in relation to the direction of relative movement between printheads 400 and the medium, such as at an angle in the range of 52 and 54 degrees, in the range of 36 and 38 degrees, or at another angle. Printheads 400 are installed as a daisy-chain 900 so that a print fluid flows from one printhead to another. I/O ports 411-412 and 713-714 may act as an "inlet" I/O port that receives a flow of print fluid, or an "outlet" I/O port that conveys a flow of print fluid out of a printhead depending on where a printhead 400 is installed in the chain. For example, the "inlet" I/O ports 713-714 on the left-most printhead 400 (i.e., the first printhead) are connected to supply hoses 910-911, respectively, which are in turn are connected to a reservoir or the like. The "outlet" I/O ports 411-412 on the left-most printhead 400 are fluidly coupled to the "inlet" I/O ports 713-714 on the next printhead 400 (i.e., the second printhead) in the chain. The "outlet" I/O ports 411-412 on the second printhead 400 are connected to the "inlet" I/O ports 713-714 on the next printhead 400 (i.e., the third printhead) in the chain. Other printheads 400 are fluidly coupled in a similar manner. On the right-most printhead 400 (i.e., the sixth printhead) in the chain, the "outlet" I/O ports 411-412 are fluidly coupled to return hoses 912-913 (or another supply hose), respectively, which in turn are connected to a reservoir or the like. Printheads 400 may be mounted in jetting apparatus 100 so that the "inlet" I/O ports on one printhead 400 are aligned with the "outlet" I/O ports on another printhead 400. An O-ring, gasket, seal, or the like may be used to seal the connection between an "inlet" I/O port and an "outlet" I/O port.

As is evident in FIG. 9, the ends of daisy-chain 900 (e.g., the leftmost and rightmost printheads 400) are connected to one or more reservoirs via hoses 910-913. The printheads 400 are linked together via I/O ports and chain manifolds 813-814 to form integrated chain manifolds 920. For example, a print fluid may flow from supply hose 910, into the leftmost printhead 400, and along one of the integrated chain manifolds 920 until exiting the chain at the rightmost printhead 400 through hose 912. The print fluid may flow from supply hose 911, into the leftmost printhead 400, and along the other integrated chain manifold 920 until exiting the chain at the rightmost printhead 400 through hose 913. Thus, the interior printheads 400 do not need to be directly connected to a reservoir via a hose, and print fluid may be supplied to these printheads 400 through integrated chain manifolds 920. This makes the printheads 400 easier to install in jetting apparatus 100, and easier to maintain.

Figure 10:
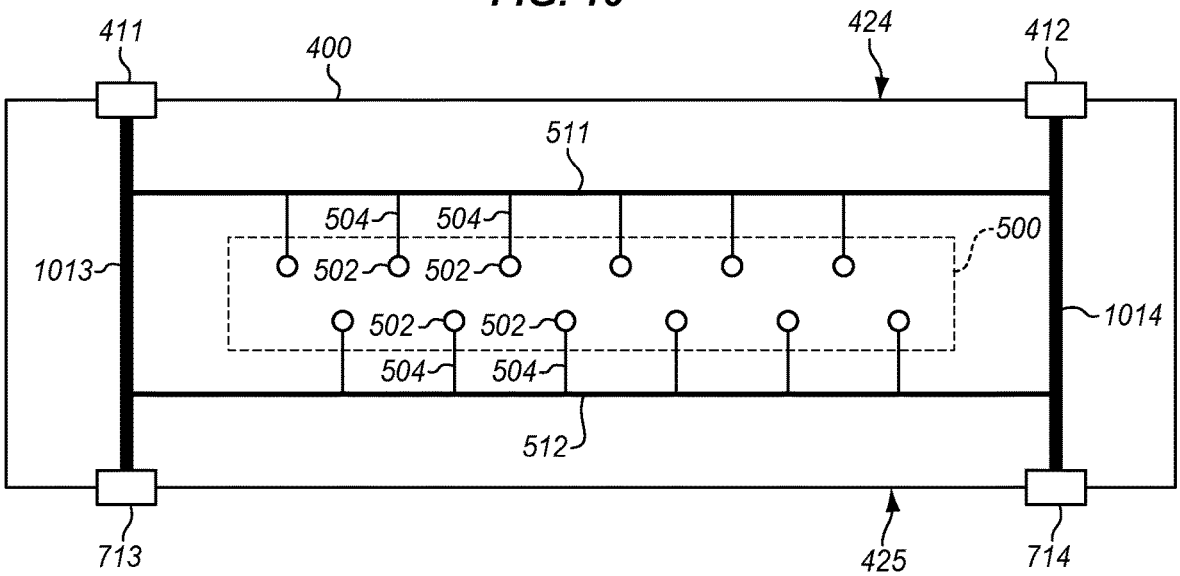
FIG. 10 is a schematic diagram of a printhead in another illustrative embodiment.

FIG. 10 is a schematic diagram of a printhead 400 in another illustrative embodiment. The jetting channels 500 of printhead 400 are schematically illustrated in FIG. 10 as nozzles in two nozzle rows, although the nozzles may be arranged in more or less nozzle rows in other embodiments. Printhead 400 includes one or more supply manifolds 511-512 that are disposed longitudinally within printhead 400. As stated above, a supply manifold is a groove, duct, conduit, etc., configured to convey or supply a print fluid to jetting channels. In this embodiment, supply manifold 511 is fluidly coupled to a subset of the jetting channels 500 (or each of the jetting channels 500 in the case of a flow-through printhead) indicated by nozzles 502 via fluid path 504. Supply manifold 512 is fluidly coupled to a subset of the jetting channels 500 (or each of the jetting channels 500 in the case of a flow-through printhead) indicated by nozzles 502 via fluid path 504. Fluid paths 504 are provided in the form of restrictors. Although two supply manifolds are illustrated, there may be a single supply manifold (e.g., such as in the case of a single row of jetting channels), or more than two supply manifolds.

In this embodiment, printhead 400 includes a pair of I/O ports 411-412 on longitudinal side 424, and a pair of I/O ports 713-714 on longitudinal side 425. Printhead 400 also includes chain manifolds 1013-1014. Chain manifold 1013 fluidly couples I/O port 713 on longitudinal side 425 with I/O port 411 on longitudinal side 424. I/O port 713 is transversely aligned with I/O port 411 across the width of printhead 400. Thus, chain manifold 1013 is disposed transversely across the width of printhead 400 between I/O port 713 and I/O port 411. Chain manifold 1014 fluidly couples I/O port 714 on longitudinal side 425 with I/O port 412 on longitudinal side 424. I/O port 714 is transversely aligned with I/O port 412 across the width of printhead 400. Thus, chain manifold 1014 is disposed transversely across the width of printhead 400 between I/O port 714 and I/O port 412. With this configuration, printhead 400 may be installed in a jetting apparatus parallel to the direction of relative movement between printhead 400 and the medium. Supply manifolds 511-512 are fluidly coupled at one end to chain manifold 1013, and fluidly coupled at the other end to chain manifold 1014.

Figure 11:
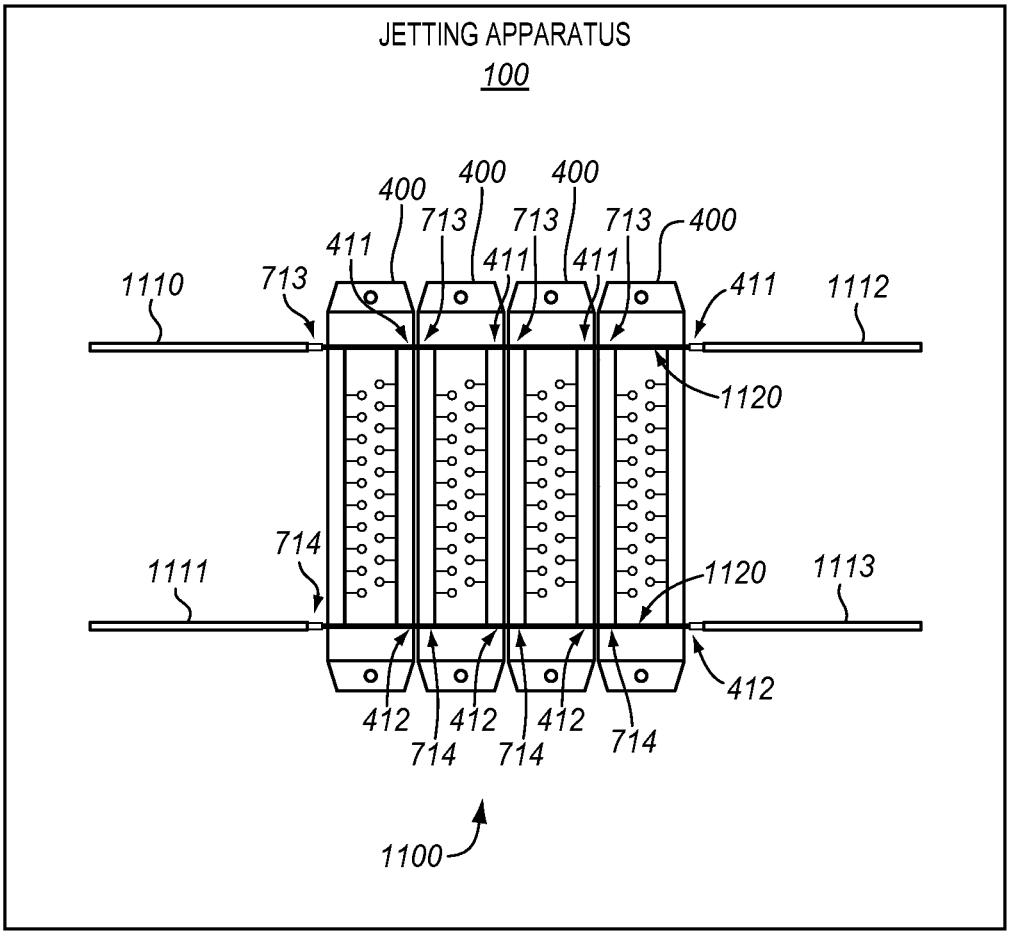
FIG. 11 illustrates multiple printheads mounted in a jetting apparatus in an illustrative embodiment.

FIG. 11 illustrates multiple printheads 400 mounted in a jetting apparatus 100 in an illustrative embodiment. In this embodiment, printheads 400 are installed parallel to the direction of relative movement between printheads 400 and the medium. Printheads 400 are installed as a daisy-chain 1100 so that a print fluid flows from one printhead to another. I/O ports 411-412 and 713-714 may act as an "inlet" I/O port that receives a flow of print fluid, or an "outlet" I/O port that conveys a flow of print fluid out of a printhead depending on where a printhead 400 is installed in the chain. For example, the "inlet" I/O ports 713-714 on the left-most printhead 400 (i.e., the first printhead) are connected to supply hoses 1110-1111, respectively, which are in turn are connected to a reservoir or the like. The "outlet" I/O ports 411-412 on the left-most printhead 400 are fluidly coupled to the "inlet" I/O ports 713-714 on the next printhead 400 (i.e., the second printhead) in the chain. The "outlet" I/O ports 411-412 on the second printhead 400 are connected to the "inlet" I/O ports 713-714 on the next printhead 400 (i.e., the third printhead) in the chain. Other printheads 400 are fluidly coupled in a similar manner. On the right-most printhead 400 (i.e., the fourth printhead) in the chain, the "outlet" I/O ports 411-412 are fluidly coupled to return hoses 1112-1113 (or another supply hose), respectively, which in turn are connected to a reservoir or the like. Printheads 400 may be mounted in jetting apparatus 100 so that the "inlet" I/O ports on one printhead 400 are aligned with the "outlet" I/O ports on another printhead 400. An O-ring, gasket, seal, or the like may be used to seal the connection between an "inlet" I/O port and an "outlet" I/O port.

As is evident in FIG. 11, the ends of daisy-chain 1100 (e.g., the leftmost and rightmost printheads 400) are connected to one or more reservoirs via hoses 1110-1113. The printheads 400 are linked together via I/O ports and chain manifolds 1013-1014 to form integrated chain manifolds 1120. For example, a print fluid may flow from supply hose 1110, into the leftmost printhead 400, and along one of the integrated chain manifolds 1120 until exiting the chain at the rightmost printhead 400 through hose 1112. The print fluid may flow from supply hose 1111, into the leftmost printhead 400, and along the other integrated chain manifold 1120 until exiting the chain at the rightmost printhead 400 through hose 1113. Thus, the interior printheads 400 do not need to be directly connected to a reservoir via a hose, and print fluid may be supplied to these printheads 400 through integrated chain manifolds 1120. This makes the printheads 400 easier to install in jetting apparatus 100, and easier to maintain.

Although specific embodiments were described herein, the scope of the invention is not limited to those specific embodiments. The scope of the invention is defined by the following claims and any equivalents thereof.

What is claimed is:

1. A printhead comprising:

a plurality of jetting channels having nozzles on a bottom surface configured to jet a print fluid;

longitudinal sides disposed transverse to the bottom surface, and opposite one another across a width of the printhead;

Input/Output (I/O) ports configured to convey the print fluid into or out of the printhead, the I/O ports comprising a first I/O port and a second I/O port disposed on a first one of the longitudinal sides, and a third I/O port and a fourth I/O port disposed on a second one of the longitudinal sides opposite the first one of the longitudinal sides;

a first chain manifold that fluidly couples the first I/O port on the first one of the longitudinal sides to the third I/O port on the second one of the longitudinal sides; and a second chain manifold that fluidly couples the second I/O port on the first one of the longitudinal sides to the fourth I/O port on the second one of the longitudinal sides.

2. The printhead of claim 1 further comprising:

a supply manifold disposed longitudinally, and configured to fluidly couple the I/O ports to the jetting channels;

wherein the first chain manifold and the second chain manifold are disposed across the width of the printhead;

wherein the supply manifold is fluidly coupled at a first end to the first chain manifold, and is fluidly coupled at a second end to the second chain manifold.

3. The printhead of claim 1 wherein:

the first I/O port is transversely aligned with the third I/O port, and the first chain manifold is disposed transversely across the width of the printhead between the first I/O port and the third I/O port; and the second I/O port is transversely aligned with the fourth I/O port, and the second chain manifold is disposed transversely across the width of the printhead between the second I/O port and the fourth I/O port.

4. The printhead of claim 1 wherein:

the first I/O port is staggered in relation to the third I/O port, and the first chain manifold is disposed at an angle across the width of the printhead between the first I/O port and the third I/O port; and the second I/O port is staggered in relation to the fourth I/O port, and the second chain manifold is disposed at an angle across the width of the printhead between the second I/O port and the fourth I/O port.

5. The printhead of claim 1 wherein:

at least one of the I/O ports includes a hose coupling.

6. A jetting apparatus comprising:

a mounting bracket configured to mount multiple ones of the printhead according to claim 1 in a daisy chain.

7. A jetting apparatus comprising:

a plurality of printheads installed perpendicular to a direction of relative movement between the printheads and a medium;

wherein each printhead of the plurality comprises:

a plurality of jetting channels having nozzles on a bottom surface configured to jet a print fluid;

longitudinal sides disposed transverse to the bottom surface, and opposite one another across a width of the printhead;

Input/Output (I/O) ports disposed on a longitudinal side of the printhead, and configured to convey the print fluid into or out of the printhead; and a chain manifold disposed between the I/O ports;

wherein the printheads are installed as a daisy-chain with an outlet I/O port of one of the printheads aligned with and facing an inlet I/O port of a next one of the printheads in the daisy-chain, and a seal between the outlet I/O port and the inlet I/O port so that the print fluid flows from the one of the printheads to the next one of the printheads.

8. The jetting apparatus of claim 7 wherein:

the printhead further comprises:

one or more supply manifolds disposed longitudinally, and configured to fluidly couple the I/O ports to the jetting channels; and the chain manifold has a lower flow resistance than the supply manifolds.

9. The jetting apparatus of claim 7 wherein:

the printheads at ends of the daisy-chain are connected to a reservoir via a hose.

10. The jetting apparatus of claim 7 wherein:

the printhead further comprises one or more supply manifolds disposed longitudinally, and configured to fluidly couple the I/O ports to the jetting channels; and a first one of the supply manifolds and the chain manifold are defined by a common duct.

11. A jetting apparatus comprising:

a plurality of printheads;

wherein each printhead of the plurality comprises:

a plurality of jetting channels having nozzles on a bottom surface configured to jet a print fluid;

longitudinal sides disposed transverse to the bottom surface, and opposite one another across a width of the printhead;

Input/Output (I/O) ports configured to convey the print fluid into or out of the printhead, wherein the I/O ports comprise a first I/O port and a second I/O port disposed on a first longitudinal side of the printhead, and a third I/O port and a fourth I/O port disposed on a second longitudinal side of the printhead opposite the first longitudinal side;

a first chain manifold disposed between the first I/O port on the first longitudinal side and the third I/O port on the second longitudinal side; and a second chain manifold disposed between the second I/O port on the first longitudinal side and the fourth I/O port on the second longitudinal side;

wherein the printheads are installed as a daisy-chain via the I/O ports, the first chain manifold, and the second chain manifold;

wherein an outlet I/O port of one of the printheads is aligned with and facing an inlet I/O port of a next one of the printheads in the daisy-chain, and a seal is disposed between the outlet I/O port and the inlet I/O port so that the print fluid flows from the one of the printheads to the next one of the printheads.

12. The jetting apparatus of claim 11 wherein:

the printhead further comprises one or more supply manifolds disposed longitudinally, and configured to fluidly couple the I/O ports to the jetting channels; and the first chain manifold and the second chain manifold have a lower flow resistance than the supply manifolds.

13. The jetting apparatus of claim 12 wherein:

the printheads at ends of the daisy-chain are connected to a reservoir via a hose.

14. The jetting apparatus of claim 11 wherein:

the printheads are installed at an angle to a direction of relative movement between the printheads and a medium.

15. The jetting apparatus of claim 14 wherein:

the first I/O port is staggered in relation to the third I/O port, and the first chain manifold is disposed at an angle across the width of the printhead between the first I/O port and the third I/O port; and the second I/O port is staggered in relation to the fourth I/O port, and the second chain manifold is disposed at an angle across the width of the printhead between the second I/O port and the fourth I/O port.

16. The jetting apparatus of claim 11 wherein:

the printheads are installed parallel to a direction of relative movement between the printheads and a medium.

17. The jetting apparatus of claim 16 wherein:

the first I/O port is transversely aligned with the third I/O port, and the first chain manifold is disposed transversely across the width of the printhead between the first I/O port and the third I/O port; and the second I/O port is transversely aligned with the fourth I/O port, and the second chain manifold is disposed transversely across the width of the printhead between the second I/O port and the fourth I/O port.

18. The jetting apparatus of claim 11 wherein:

the printhead further comprises one or more supply manifolds disposed longitudinally, and configured to fluidly couple the I/O ports to the jetting channels; and the supply manifolds are fluidly coupled at one end to the first chain manifold, and fluidly coupled at the other end to the second chain manifold.

* * * * *